US008033084B1

(12) United States Patent
Peterson et al.

(10) Patent No.: US 8,033,084 B1
(45) Date of Patent: Oct. 11, 2011

(54) AUTOMATED BIN FILLING SYSTEM

(75) Inventors: Donald Peterson, Martinsburg, WV (US); Scott D. Wolford, Martinsburg, WV (US); William C. Anger, Ocala, FL (US)

(73) Assignee: The United States of America, as represented by the Secretary of Agriculture, Washington, DC (US)

( * ) Notice: Subject to any disclaimer, the term of this patent is extended or adjusted under 35 U.S.C. 154(b) by 158 days.

(21) Appl. No.: 12/380,799

(22) Filed: Mar. 4, 2009

(51) Int. Cl.
*B65B 1/04* (2006.01)

(52) U.S. Cl. ..... 53/473; 53/475; 53/531; 53/540; 53/245

(58) Field of Classification Search ..... 53/538, 53/540, 541, 539, 475, 473, 242, 244, 245, 53/248, 531
See application file for complete search history.

(56) References Cited

U.S. PATENT DOCUMENTS

| | | | | | |
|---|---|---|---|---|---|
| 4,067,432 | A | | 1/1978 | Powell, Sr. | |
| 4,194,343 | A | | 3/1980 | Myers et al. | |
| 4,203,274 | A | * | 5/1980 | Warkentin et al. | 53/537 |
| 4,294,059 | A | * | 10/1981 | Stilwell et al. | 53/448 |
| 4,329,831 | A | * | 5/1982 | Warkentin et al. | 53/537 |
| 4,435,941 | A | * | 3/1984 | Booth et al. | 53/475 |
| 4,446,670 | A | * | 5/1984 | Compagnoni | 53/244 |
| 4,501,350 | A | * | 2/1985 | Muller et al. | 198/477.1 |
| 4,514,956 | A | * | 5/1985 | Varallo et al. | 53/148 |
| 4,765,487 | A | * | 8/1988 | Bliss | 209/510 |
| 4,965,982 | A | | 10/1990 | Jesperson et al. | |
| 5,123,231 | A | * | 6/1992 | Fallas et al. | 53/493 |
| 5,502,949 | A | * | 4/1996 | Main et al. | 53/448 |
| 5,555,706 | A | * | 9/1996 | Maoloni et al. | 53/447 |
| 5,598,771 | A | | 2/1997 | Main et al. | |
| 5,605,031 | A | * | 2/1997 | Prakken | 53/537 |
| 5,661,949 | A | * | 9/1997 | Blanc | 53/237 |
| 5,772,004 | A | * | 6/1998 | Main | 198/536 |
| 5,794,415 | A | * | 8/1998 | Huff et al. | 53/475 |
| 5,803,704 | A | * | 9/1998 | Lazzarotti | 414/793.4 |
| 6,431,818 | B1 | * | 8/2002 | Place | 414/808 |
| 6,644,905 | B1 | | 11/2003 | Peterson et al. | |

* cited by examiner

*Primary Examiner* — Hemant M Desai
(74) *Attorney, Agent, or Firm* — John D. Fado; Robert D. Jones

(57) ABSTRACT

The automated bin filling system provides an efficient means of placing a relatively fragile bulk product into a container (such as a bulk storage bin) without substantially damaging the product. Specifically, the bin filling system moves bulk products (preferably fruits or vegetables) from a feed conveyor into a product accumulation section where the product is arranged to be uniformly loaded into a mobile tray. Once the mobile tray is filled, the tray is lowered into the bin and gently deposited. The empty tray is then elevated and retracted to its initial position and the loading cycle is repeated. This process continues until the bin is filled.

21 Claims, 8 Drawing Sheets

AUTOMATED BIN FILLING SYSTEM

FIELD OF THE INVENTION

The present invention relates to an automated mechanical bin filling system. Specifically, the invention relates to a means of moving a bulk product (preferably fruits or vegetables) from a feed conveyor to a mobile storage bin so that the product is not bruised or otherwise adversely affected.

BACKGROUND OF THE INVENTION

Millions of pounds of agricultural products are harvested, packed, and shipped, yearly. Conventional packing devices are designed to move bulk products quickly and efficiently, many times at the cost of bruising and destroying significant quantities of the product. In addition to the products that are destroyed, those that are merely damaged (but not immediately destroyed) are vulnerable to insects, disease, and accelerated decay. These damaged products are mixed with previously undamaged products so that the damaged goods are difficult to remove and may spread rot and disease to otherwise healthy products that are stored in a common storage area.

Previous attempts to limit damage to agricultural products during the packing process have been expensive, complex, and in some cases counterproductive. One means of minimizing product damage is through the use of "water handling" devices. These devices use water to cushion and protect a product from the impacts associated with the harvesting and packing process as the product is moved from one container to the next.

However, these devices require a series of tanks, pumps, and filters that must be cleaned and maintained during the harvesting and packaging process. This equipment takes up additional space, is cumbersome for workers, and generally increases product handling costs and slows the overall packing process. Further, wet handling has the potential to facilitate the spread of post-harvest diseases.

The need exists for a product handling method that efficiently transfers bulk products from a conveyor-type feeder to a storage container without significantly damaging the products. The current invention comprises a compact, efficient, reliable means of transferring products from a conveyor-type feeder to a storage means while imparting little or no damage to the products.

SUMMARY OF THE INVENTION

This disclosure is directed to a system and a method of filling a storage receptacle. In the preferred embodiment, the storage receptacle is a bulk products bin that is moveable with a conventional forklift.

The system includes an accumulation section with a plurality of helical and non-helical brushes. A feed conveyor directs products into the accumulation section. The volumetric flow of products and the rotation of the accumulation section brushes push the products through the accumulation section and into a transfer container positioned at an output end of the accumulation section. At least one optical proximity sensor monitors an area adjacent to the accumulation section for the presence of voids. A transfer container extension means moves the transfer container horizontally, and an elevator apparatus moves the transfer container vertically.

A product loading cycle is initiated when a product is gathered in the accumulation section and urged into the transfer container. When the optical proximity sensor detects that there are no voids adjacent the accumulation section, the transfer container extension means incrementally extends the transfer container away from the accumulation section until the transfer container is filled with products. The elevator apparatus then moves the transfer container into the bin and deposits the products.

DETAILED DESCRIPTION OF PREFERRED EMBODIMENTS

The present invention comprises a mechanical system 30 for filling a storage receptacle 32. In the preferred embodiment, the storage receptacle is a rectangular bin that is movable by a conventional forklift. The system 30 is particularly useful in moving bulk products (like fruits and vegetables) that do not have a uniform size or shape. Although the system 30 may be used to move any type of product vulnerable to bruising or breakage, for the sake of simplicity, this disclosure uses fruit as an exemplary product.

Figure 1:
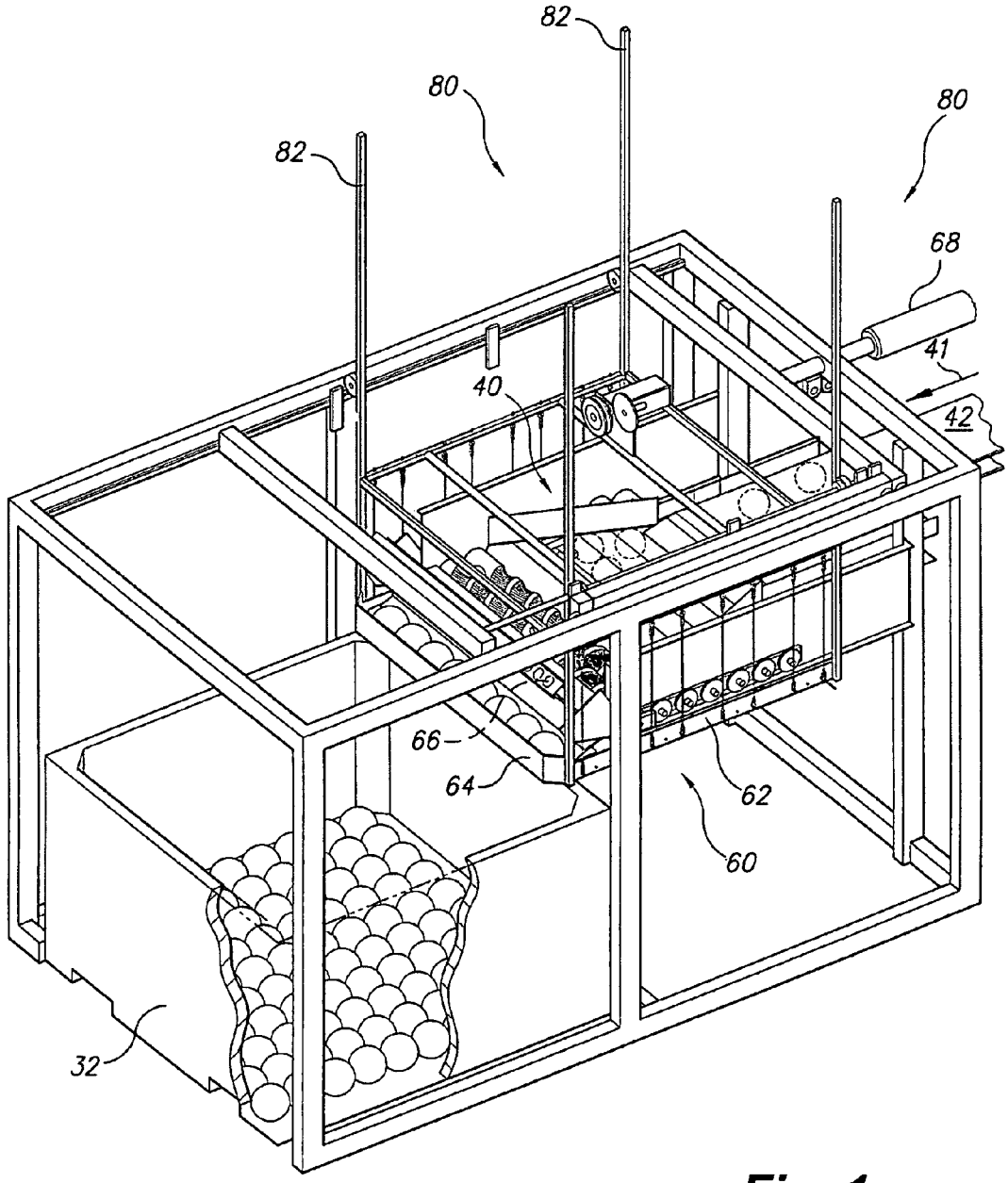
FIG. 1 is a perspective view of the current invention prior to the start of the loading process. The transfer tray is shown in the elevated and retracted position.

As generally shown in FIG. 1, the system 30 comprises mechanical, electrical and hydraulic components associated with three primary functional groups: a product accumulation section 40, a transfer container assembly 60, and an elevator and support apparatus 80. In the preferred embodiment, the transfer container assembly 60 comprises a mechanical means to support and move a rectangular tray component 62.

Figure 2:
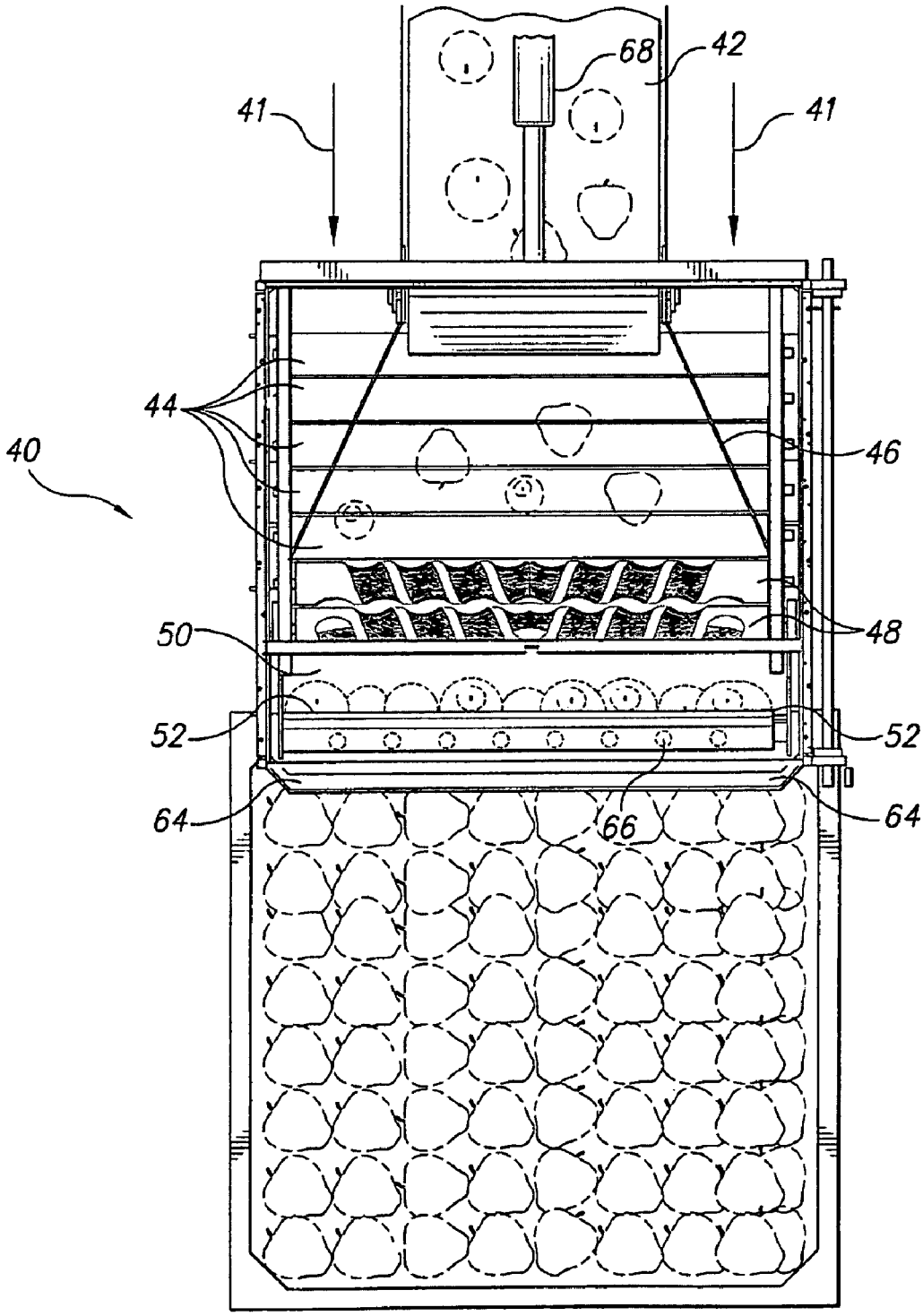
FIG. 2 is a top view of the accumulation section. The transfer tray is shown in the elevated and retracted position at the initiation of the loading cycle.
Figure 3:
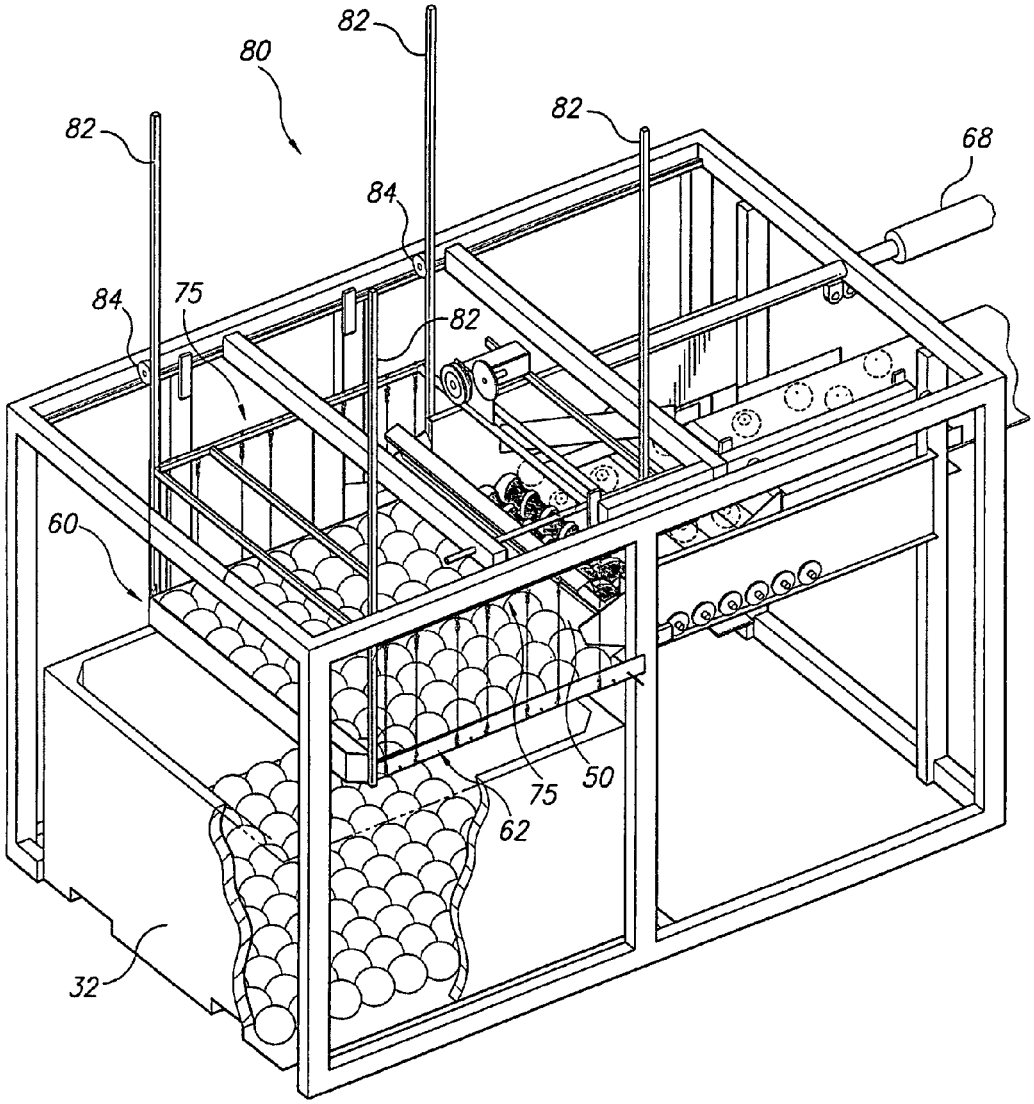
FIG. 3 is a perspective view of the system with the transfer tray partially loaded. The transfer tray is shown in the elevated and partially extended position.
Figure 4:
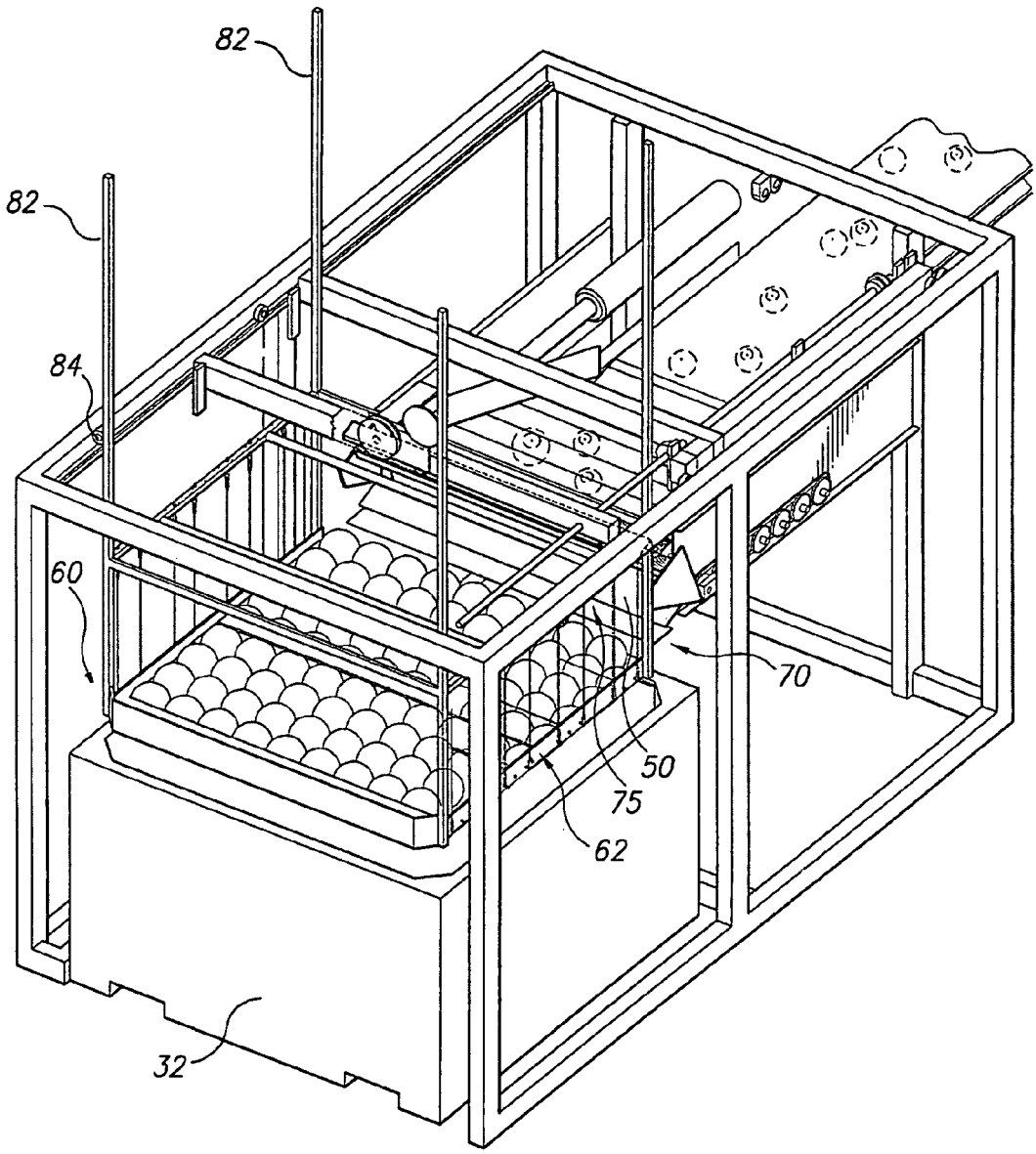
FIG. 4 is a perspective view of the system with transfer tray fully loaded. The transfer tray is shown in the elevated and fully extended position.
Figure 5:
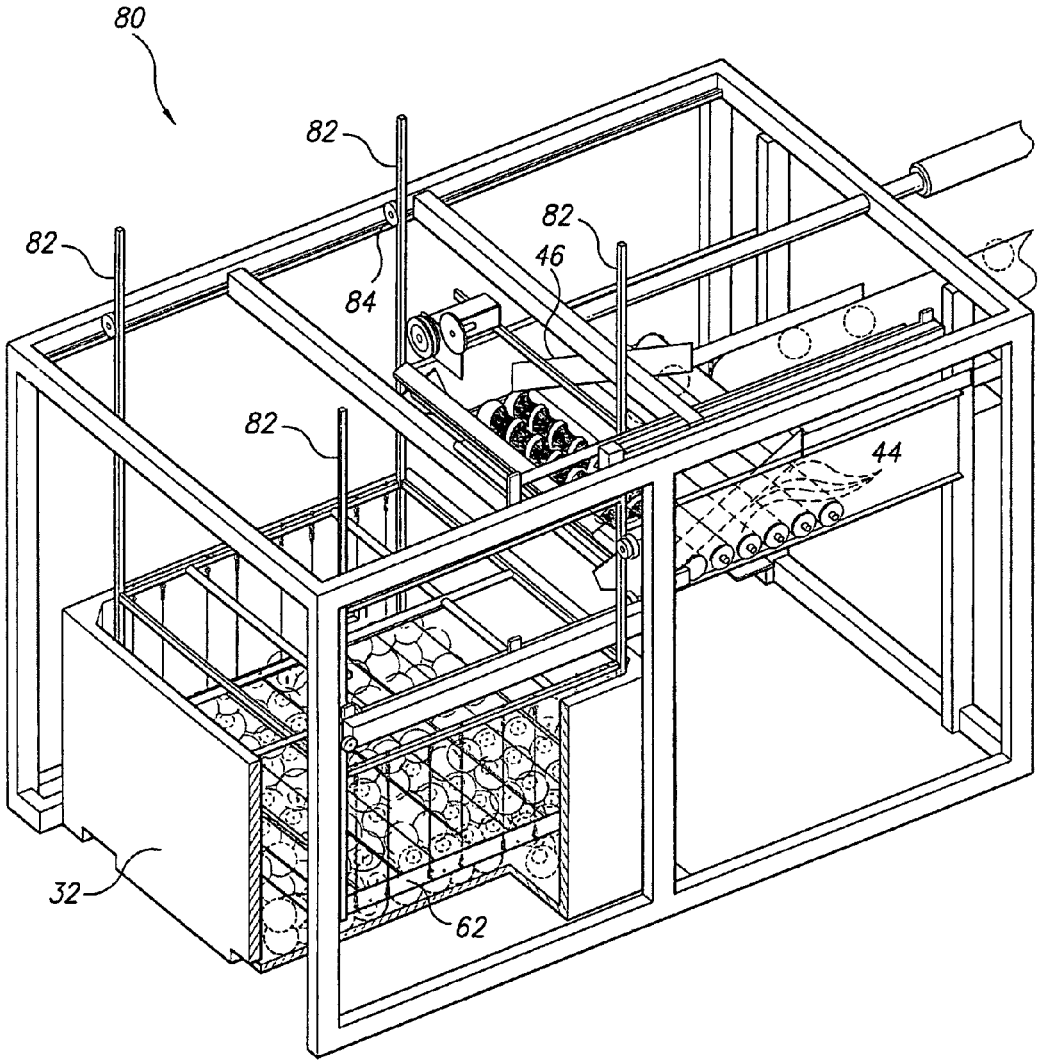
FIG. 5 is a perspective view of the system with the transfer tray fully loaded and in position to deposit a product in the bin. The tray is shown in lowered and fully extended position.
Figure 6:
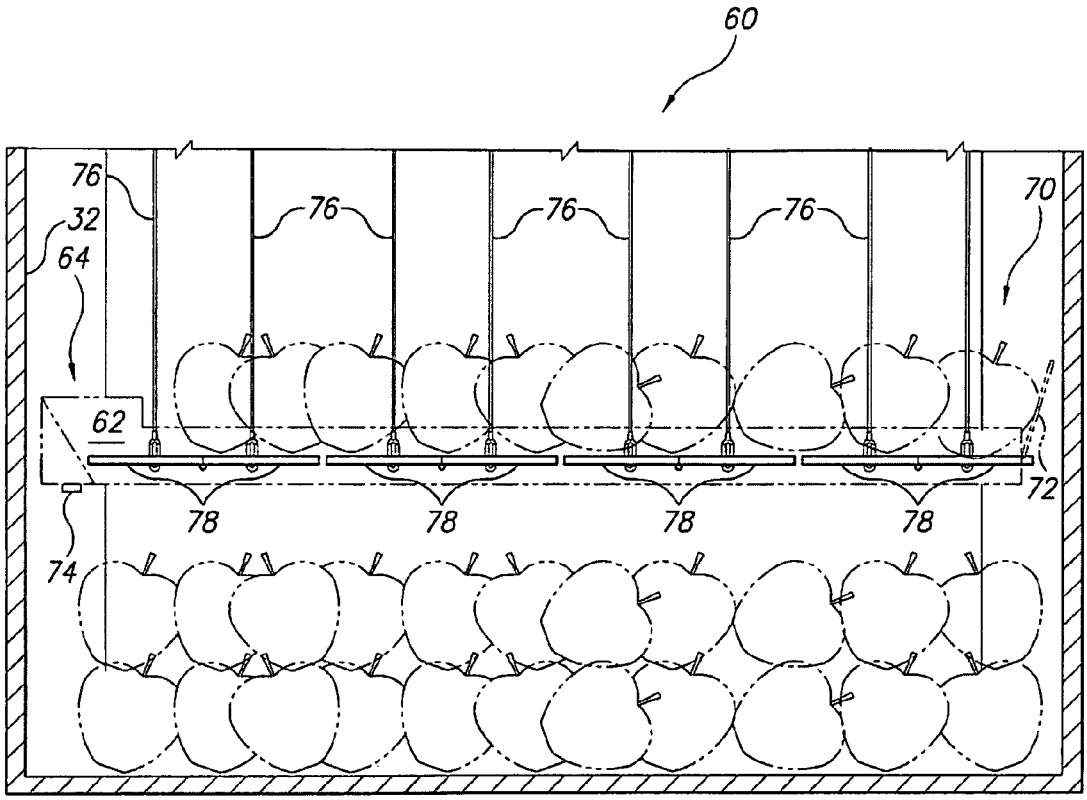
FIG. 6 is a profile view of the transfer tray with the tray floor panels in the closed (horizontal) position. The transfer tray is shown in the lowered and fully extended position (See FIG. 5).
Figure 7:
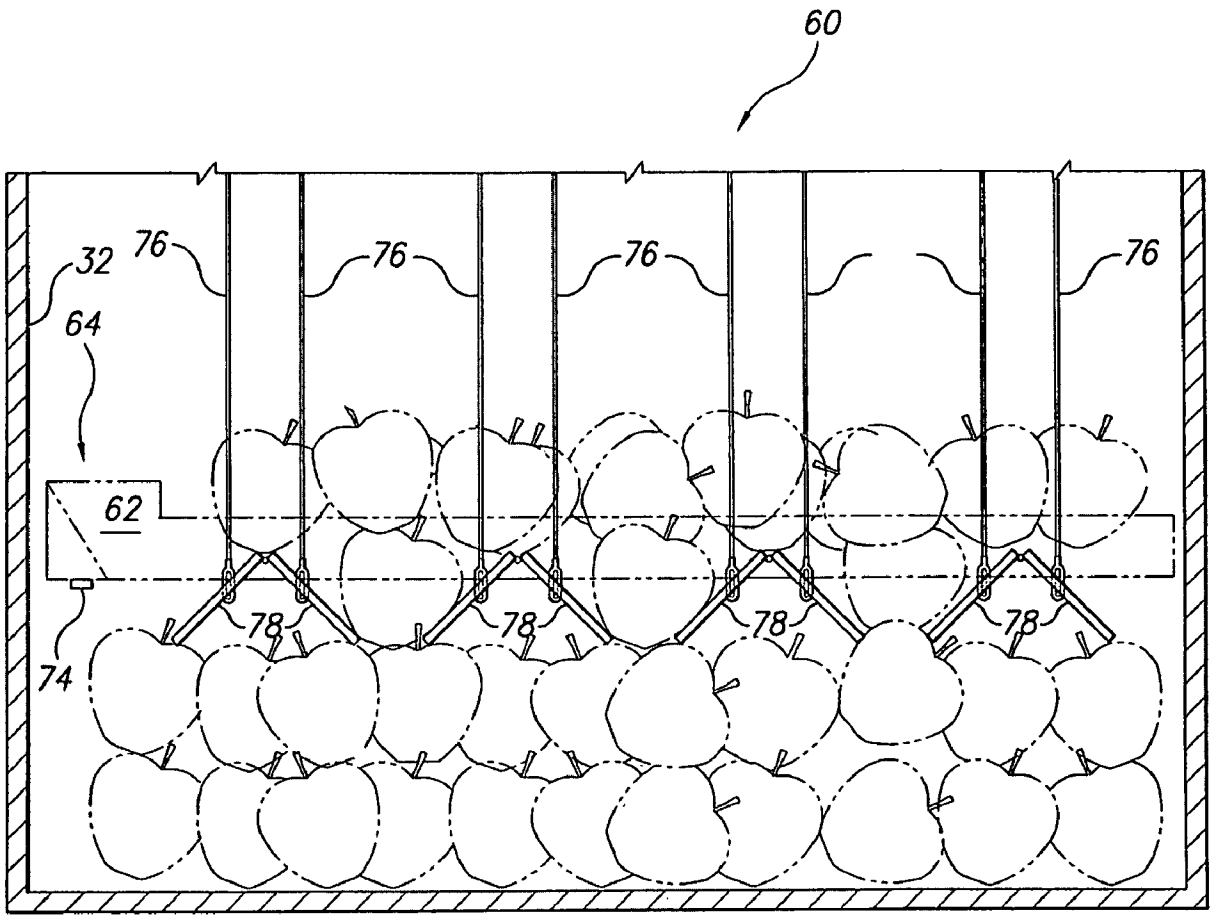
FIG. 7 is a profile view of the transfer tray with the transfer tray floor panels in the open (partially vertical) position so that the fruit is deposited in bin. The transfer tray is shown in the lowered and fully extended position.
Figure 8:
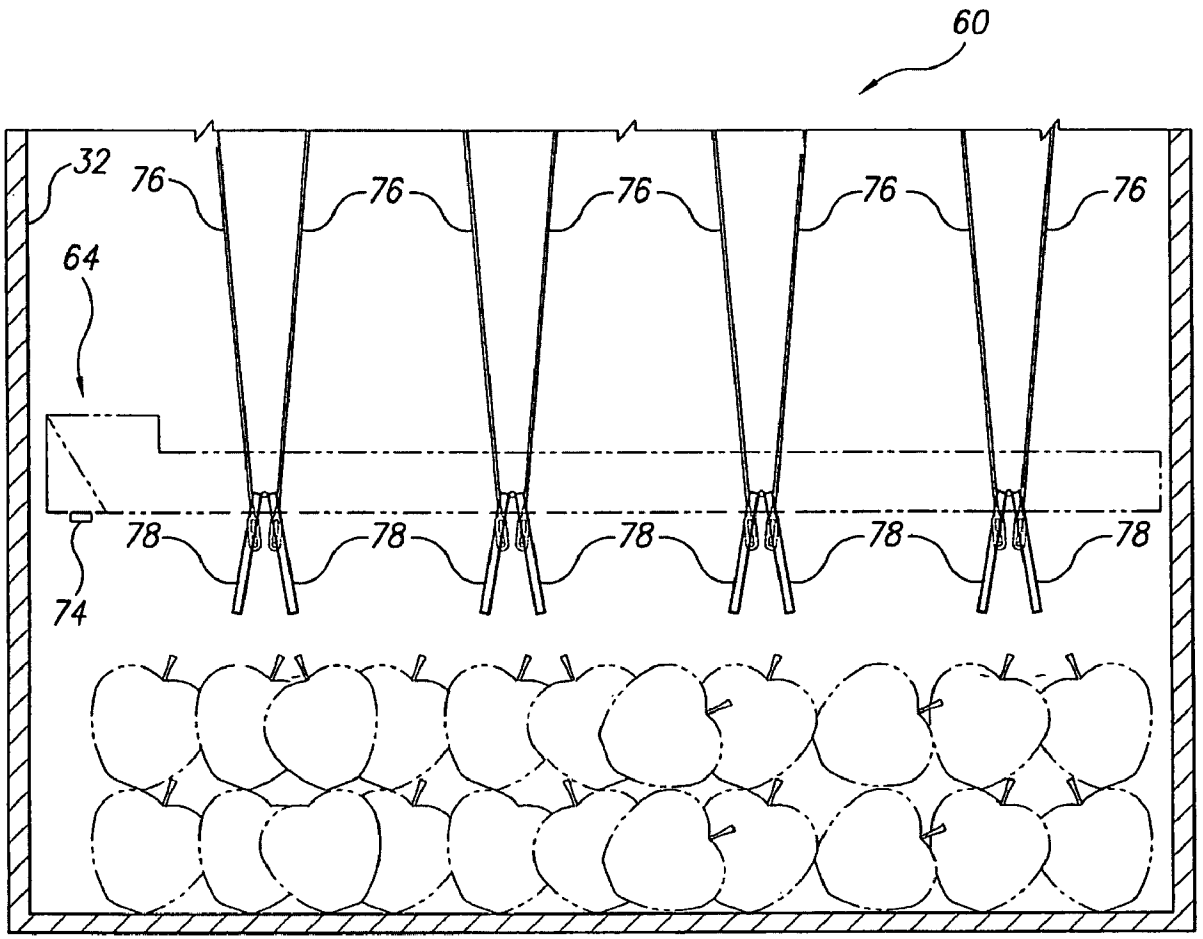
FIG. 8 is a profile view of the transfer tray with the transfer tray floor panels in the open (vertical) position. The transfer tray is shown in the fully extended partially elevated position.

As shown in FIGS. 1 and 2, in operation, fruit is initially fed into the accumulation section 40 in the direction of the arrow 41 via a feed conveyor belt 42. The fruit is gathered and distributed uniformly across the accumulation section 40 and fed into the tray 62. As successive rows of the transfer tray 62 are filled, the tray advances horizontally away from the accumulation section 40 until the entire tray 62 is filled. FIG. 3 shows the transfer tray 62 partially extended, and FIG. 4 shows the tray 62 fully extended. As shown in FIG. 5, after the tray 62 is filled, the tray 62 is lowered into the storage bin 32. FIGS. 6-8 show details of the tray 62 and tray floor panels 78 as the tray is moved from the elevated "load" position shown in FIG. 4 to the "unload" position shown in FIG. 5. Operation of the system 30 is described in greater detail infra.

As best shown in FIG. 2, fruit enters the accumulation section 40 from the feed conveyor 42 and is advanced in the direction of the arrow 41 to the first of a plurality of generally cylindrical roller brushes 44. In the preferred embodiment, the tops of the roller brushes 44 rotate in the direction that the fruit is advanced, however the rotation of the brushes 44 alone is not sufficient to propel the fruit forward. The fruit is gently pushed forward by both the rotation of brushes 44 as well as the volumetric flow of new articles of fruit leaving the conveyor belt 42 and entering the accumulation section 40. This design ensures that the fruit is generally "gathered" in the initial stages of the accumulation section 40 and moves through the accumulation section 40 as a cluster, thereby minimizing the force of the fruit's collisions in the accumulation section 40.

As shown in FIG. 2, if the feed conveyor 42 is narrower than the width of the roller brushes 44, outwardly angled side panels 46 maintain the fruit within the accumulation section 40 while allowing the stream of fruit to expand to the full width of the roller brushes 44. After the fruit passes over the cylindrical roller brushes 44 it is directed to a plurality of helical roller brushes 48. These brushes 48 are similar to the cylindrical roller brushes 44 however they have helical outer contours so that (starting at the center of the brush 48) half of the helical portion of the brush 48 has a clockwise orientation, and the other half has a counter clockwise orientation.

As best shown in FIG. 2, the helical shape of the brushes 48 moves the fruit outwardly away from the center of the accumulation section 40, thereby ensuring that the fruit is fully distributed across the width of the section 40. The fruit then moves down a transfer incline 50 and into the transfer tray 62.

Although the FIG. 2 exemplary embodiment shows five cylindrical brushes 44 and 2 helical brushes 48, in alternative embodiments there may be a lesser or greater number of either type of brush 44, 48. Further, although the preferred embodiment shows the brushes 44, 48 as having an essentially uninterrupted cylindrical or helical contour, in alternative embodiments the brushes 44, 48 may have any contour or texture known in the art and may be comprised of smooth, grooved, or otherwise textured rollers either with or without traditional bristles. Although these alternative embodiments are not obvious, they should be considered to be disclosed and within the scope of the current invention.

As shown in FIGS. 1 and 2, at the beginning of the tray-loading cycle, a distal end 64 of the tray 62 is positioned adjacent a delivery end 52 of the transfer incline 50 so that the remainder of the tray 62 is positioned below the accumulation section 40. An array of optical product proximity sensors 66 is directed toward the delivery end 52 of the transfer incline 50. In alternative embodiments, the sensors 66 may utilize any technology known in the art consistent with the functions described herein.

As the fruit feeds into the tray 62, the product proximity sensors 66 sense the presence or absence of fruit adjacent to the delivery end 52 of the transfer incline 50. Specifically, the product proximity sensors 66 monitor a selected area adjacent to the delivery end 52 of the transfer incline 50 for voids. For the purposes of this disclosure, a "void" is defined as an absence of fruit in a selected area that would otherwise be filled with fruit.

When the product proximity sensors 66 indicate that there are no voids and all of the space adjacent to the delivery end 52 of the transfer incline 50 is filled with fruit, the proximity sensors 66 communicate the information to an electronic control mechanism attached to a horizontal linear actuator 68. The horizontal linear actuator 68 then incrementally slides the tray 62 horizontally away from the transfer incline 50 until at least one of the proximity sensors 66 detects a void (i.e. an absence of fruit) adjacent to the transfer incline 50. As fruit continues to move through the accumulation section 40 and down the transfer incline 50, the previously detected void(s) is filled by incoming fruit.

When the product proximity sensors 66 detect that there are (once again) no voids adjacent to the delivery end 52 of the transfer incline 50, the horizontal linear actuator 68 (once again) incrementally advances the tray 62 until another void is detected. When the void is detected the advance of the tray 62 is halted until the void is filled by incoming fruit, at which time the tray 62 advances again. FIG. 3 shows the tray 62 in the partially extended position.

As best shown in FIG. 4, the incremental extension and loading process continues until the tray is 62 fully extended and the transfer incline 50 is adjacent to a proximal edge 70 of the tray 62. Once the tray 62 is in the fully extended position, a limit switch on the tray extension linear actuator 68 is engaged. In the preferred embodiment, the limit switch deactivates the feed conveyor 42 and stops the rotation of the roller brushes 46, 48 so that the flow of fruit is halted. The transfer incline 50 is then rotated upwardly to a level position to prevent any additional fruit from flowing off the incline 50 and into the tray 62.

In alternative embodiments, the transfer incline 50 may continue to rotate upwardly (past level) so that the transfer incline 50 is angled back toward the fruit accumulation section 40 thereby further ensuring that no additional fruit rolls off the transfer incline 50. Alternatively a panel (not shown) on the edge of the transfer incline 50 may pivot upwardly to form a barrier/wall that prevents additional fruit from leaving the transfer incline 50.

As best shown in FIG. 5, the tray 62 is then shifted to a centered position above the bin 32. As the tray 62 is shifted, a spring loaded panel (attached to the frame) deploys to prevent fruit from rolling off the proximal end 70 of the tray 62. The tray 62 is then lowered into the bin 32 by the elevator and support apparatus 80. In the preferred embodiment, the elevator and support apparatus 80 is comprised of a rack 82 and pinion 84 drive system. Specifically, four rack components 82 are positioned adjacent the corners of the tray 62 and four corresponding pinion or cog components 84 are mated to the teeth of the racks 82. The rack 82 and pinion 84 drive system ensures a smooth and level transition of the tray 62 from the elevated position shown in FIG. 4, to the lowered position shown in FIG. 5.

FIG. 6 is a more detailed view of the tray 62 in the lowered position shown in FIG. 5. The floor of the tray 62 is comprised of multiple hinged panels 78 that support the fruit in the tray 62 when the panels 78 are in a (horizontal) closed position. Support cables 76 extend from opposite ends of each of the floor panels 78. A vertical linear actuator mechanism 75 (see FIGS. 3-5) controls the tension on the cables 76. Vertical proximity sensors 74 communicate with a control mechanism that governs the vertical movement of the tray 62. In the preferred embodiment, the vertical proximity sensors 74 are ultrasonic proximity sensors.

As shown in FIG. 7, once the downward travel of the tray 62 has stopped, the vertical linear actuator mechanism 75 releases the tension on the cables 76, thereby causing the floor panels 78 to pivot downwardly so that the panels 78 rest on the top of the fruit in the bin 32 (or on the bin floor if the bin 32 is empty). The elevator apparatus 80 then begins to raise the tray 62 so that the panels 78 continue to pivot downwardly toward a vertical position. As the tray 62 is raised, the fruit that was previously in the tray 62 gently spills into the bin 32.

As shown in FIG. 8, as the tray 62 continues to move upwardly, the fruit remains in the bin 32. When the empty tray 62 reaches the elevated position shown in FIG. 4 (sans fruit), upward movement of the tray stops. The vertical linear actuator mechanism 75 then retracts the cables 76 and thereby brings the hinged floor panels 78 back to their (closed) horizontal position. The empty tray 62 is then horizontally retracted toward the accumulation section 40 until it reaches the original starting position shown in FIGS. 1 and 2. A subsequent loading cycle is then initiated and the process is repeated until the tray 62 is refilled and the next load of fruit is deposited in the bin 32.

In the preferred embodiment, elements of the system 30 such as the horizontal linear actuator 68, the pinion 84; and the vertical linear actuator 75, mechanism are hydraulically powered. However, in alternative embodiments, these components 68, 75, 84 may also be solely or partially electrically or pneumatically powered, or powered by any means consistent with the function of the invention. Further, the tray 62 may be raised, lowered, and/or extended by any means known in the art consistent with the functions described herein.

For the foregoing reasons, it is clear that the invention provides an innovative system for moving and handling fragile bulk products. The invention may be modified in multiple ways and applied in various technological applications. For example, although the invention is capable of handling fruits and vegetables, it may also be used for non-food items such as breakable containers of any variety.

The current invention may be modified and customized as required by a specific operation or application, and the individual components may be modified and defined, as required, to achieve the desired result. For example, although the receptacle 32 in the exemplary embodiment is a bin designed to be moved by a forklift, the receptacle 32 may also include larger containers such as truck trailers, rail cars, and the like, or smaller containers such as cardboard boxes, wooden crates, and the like.

Although the materials of construction are not described, they may include a variety of compositions consistent with the function of the invention. Such variations are not to be regarded as a departure from the spirit and scope of the invention, and all such modifications as would be obvious to one skilled in the art are intended to be included within the scope of the following claims.

What is claimed is:

1. A system for filling a storage receptacle, the system comprising:

an accumulation section having a plurality of brushes, at least one brush having a helical profile;

a transfer container positioned to receive a product from the accumulation section;

at least one sensor means for detecting a void adjacent the accumulation section;

a transfer container extension means for moving the transfer container horizontally; and an elevator means for moving the transfer container vertically.

2. The system of claim 1 further comprising a bin, the product being deposited in the bin.

3. The system of claim 2 wherein the transfer container is a tray.

4. The system of claim 3 wherein the at least one sensor means is a product proximity sensor.

5. The system of claim 4 wherein the proximity sensor is an optical proximity sensor.

6. The system of claim 4 wherein a transfer incline is disposed between the accumulation section and the tray, the transfer incline having a delivery end.

7. The system of claim 6 wherein the proximity sensors are directed to a selected area adjacent the delivery end of the transfer incline so that when the proximity sensors detect that there are no voids, the horizontal linear actuator advances the tray away from the accumulation section until the proximity sensors detect a subsequent void.

8. The system of claim 3 wherein the transfer container extension means is a horizontal linear actuator.

9. The system of claim 3 wherein the accumulation section comprises a plurality of helical brushes and a plurality of non-helical brushes, the tops of the helical and non-helical brushes rotating towards the tray and urging the products toward the tray.

10. The system of claim 9 wherein the product is also pushed toward the tray by additional product items entering and moving through the accumulation section.

11. The system of claim 9 wherein bristles on a first half of the helical brushes have a clockwise orientation and the bristles on a second half of the helical brushes have a counter clockwise orientation.

12. The system of claim 11 wherein the helical brushes urge the products away from a center of the helical brushes so that the products are distributed across a span of the accumulation system.

13. The system of claim 3 wherein the elevator means comprises a rack and pinion drive system.

14. The system of claim 13 wherein the rack and pinion drive system is hydraulic.

15. The system of claim 3 wherein the elevator means is structured to move the tray vertically from an elevated load position to a lowered position within the bin.

16. The system of claim 15 wherein the tray further comprises at least one vertical proximity sensor that senses one of: an effective floor of the bin, or a top of a previously deposited product.

17. The system of claim 16 wherein the vertical proximity sensors are comprised of ultrasonic proximity sensors.

18. The system of claim 3 further comprising:

a plurality of cables, each cable having a first end and a second end;

a plurality of hinged panels comprising a floor of the tray, a first end of each of the cables being attached to a respective one of the hinged panels;

a vertical linear actuator mechanism, a second end of each of the plurality of cables being attached to the vertical linear actuator mechanism.

19. The system of claim 2 wherein the tray is lowered into the bin until proximity sensors indicate that the tray is a predetermined height above one of: an effective floor of the bin, or a top of a previously deposited product, and stops the assent of the tray, so that the floor panels are released and the product is deposited in the bin.

20. The system of claim 1 further comprising a feed conveyor depositing the product in the accumulation section.

21. The system of claim 1 wherein the transfer container extension means incrementally extends the transfer container away from the accumulation section until the transfer container is filled.

* * * * *